United States Patent [19]

Rasmussen

[11] Patent Number: 4,543,969

[45] Date of Patent: Oct. 1, 1985

[54] COIN SORTER APPARATUS AND METHOD UTILIZING COIN THICKNESS AS A DISCRIMINATING PARAMETER

[75] Inventor: James M. Rasmussen, Chicago, Ill.

[73] Assignee: Cummins-Allison Corporation, Mount Prospect, Ill.

[21] Appl. No.: 492,397

[22] Filed: May 6, 1983

[51] Int. Cl.[4] ..... G07D 3/06

[52] U.S. Cl. ..... 133/3 A

[58] Field of Search ..... 133/3 R, 3 A, 8 R, 3 H; 209/915, 917; 221/167-169; 198/392

[56] References Cited

U.S. PATENT DOCUMENTS

| | | |
|---|---|---|
| 1,894,190 | 1/1933 | Myers . |
| 1,979,659 | 11/1934 | Zierick . |
| 2,231,642 | 2/1941 | Seemel . |
| 2,906,276 | 9/1959 | Blanchette et al. . |
| 2,977,961 | 4/1961 | Buchholz et al. . |
| 3,771,538 | 11/1973 | Reis . |
| 3,837,139 | 9/1974 | Roseberg . |
| 4,086,928 | 5/1978 | Ristvedt et al. . |
| 4,098,280 | 7/1978 | Ristvedt et al. . |
| 4,234,003 | 11/1980 | Ristvedt et al. . |

FOREIGN PATENT DOCUMENTS

| | | |
|---|---|---|
| 2012863 | 3/1970 | Fed. Rep. of Germany . |

*Primary Examiner*—Stanley H. Tollberg

*Attorney, Agent, or Firm*—Leydig, Voit & Mayer, Ltd.

[57] ABSTRACT

A coin sorter apparatus is provided for sorting coins by denomination using coin thickness as the discriminating parameter. The apparatus comprises a rotating disk located proximate a stationary disk. The rotational movement of coins on the rotating disk carries them into the region between the two proximate disks. Wherein a first selected are of ridges and recesses on the stationary disk surface manipulates the radial position of at least one denomination of the coins to a predetermined radial position using thickness as the discriminating parameter. A second selected area of ridges and recesses of the stationary disk receives the rotating coins carried on the rotating disk after the foregoing radial manipulation by the first selected area and radially releases rotating coins located at the predetermined radial position, thus allowing the coins to exit the region between the two disks at a particular location along the periphery of the stationary disk. Accordingly, all the coins of the one denomination whose radial position was manipulated to the predetermined radial position will be exited from the two proximate disks at the same particular location, thereby successfully sorting that coin denomination from the mixed denomination collection. Each denomination of coin having a distinguishing thickness can be similarly manipulated to distinct predetermined radial positions so that a plurality of denominations can be sorted by the stationary and rotating disk.

20 Claims, 13 Drawing Figures

COIN SORTER APPARATUS AND METHOD UTILIZING COIN THICKNESS AS A DISCRIMINATING PARAMETER

FIELD OF THE INVENTION

The present invention relates generally to an apparatus and method for sorting coin currency by denomination and, more particularly, to an apparatus and method for sorting coins by denomination using coin thickness as the discriminating parameter.

BACKGROUND OF THE INVENTION

Some businesses, particularly banks, are often faced with a large amount of coin currency at the end of a business day, week or month which must be organized, counted and recorded. To hand count and record large amounts of coins of mixed denomimations requires diligent care and effort and demands much manpower time that might otherwise be available for more profitable and less tedious activity. To make counting of coins less laborious, machines have been developed which automatically sort by denomination a mixed group of coins. Since most countries have coin currency in which each denomination of coin has a different diameter, coin sorting machines have often utilized coin diameter as the coin characteristic to discriminate between denominations. Recently, however, several major countries have introduced into their currency new coins which have diameters similar to the diameters of other coin demoninations. Consequently, sorting by coin diameter is no longer practical for sorting the coin currency of these countries.

SUMMARY OF THE INVENTION

It is the primary object of this invention to provide a coin sorter mechanism which is capable of successfully sorting coins of different denominations but having the same or similar diameters.

It is also an object of this invention to provide an economical coin sorter mechanism which can sort coins of different denominations but having the same or similar diameters at a high speed with a high degree of reliability and without jamming or fouling of the sorter mechanism.

It is a further object of this invention to provide a mechanism which automatically and continuously sorts all denominations of coins without need for hand-sorting any one or several of the coin denominations.

It is still another object of this invention to provide a coin sorter mechanism whose size allows it to be easily and conveniently placed in the work space of most businesses.

Other objects and advantages of the invention will be apparent from the following detailed description.

The invention relates to a coin sorter apparatus for sorting coins by denomination using coin thickness as the discriminating parameter. The apparatus comprises a rotating disk located proximate a stationary disk. A collection of mixed denomination coins are dropped onto the surface of the rotating disk through a central opening in the stationary disk whereby the rotating disk imparts a rotational movement to the coins. This rotational movement of the coins on the rotating disk carries them into the region between the two proximate disks. As the coins continue to rotate on the surface of the rotating disk, a first selected area of ridges and recesses on the stationary disk surface, which is proximate with the rotating disk, manipulates the radial position of at least one denomination of the coins to a predetermined radial position using thickness as the discriminating parameter. A second selected area of ridges and recesses of the stationary disk receives the rotating coins carried on the stationary disk after the radial manipulation by the first selected area and radially releases rotating coins located at the predetermined radial position, thus allowing the coins to exit the region between the two disks at a particular location along the periphery of the stationary disk. Accordingly, all the coins of the one denomination whose radial position was manipulated to the predetermined radial position will be exited from the two proximate disks at the same particular location, thereby successfully sorting that coin denomination from the mixed denomination collection. Each denomination of coin having a distinguishing thickness can be similarly manipulated to distinct predetermined radial positions so that a plurality of denominations can be sorted by the stationary and rotating disk.

Although the invention will be described in connection with certain preferred embodiments, it will be understood that it is not intended to limit the invention to those particular embodiments. On the contrary, it is intended to cover all alternatives, modification and equivalents that may be included within the spirit and scope of the invention as defined by the appended claims.

DESCRIPTION OF THE PREFERRED EMBODIMENT

The invention will be described in connection with FIGS. 1–13 by illustrating the movement of three different denominations of coins through the sorter apparatus of the invention, resulting in the proper sorting of all three coins.

A first coin denomination A is a coin which has a diameter similar to the diameter of at least one other coin in the same currency, but has a thickness dimension which is substantially greater than the other coin or coins of similar diameter. Coins of denomination A represent those new coins which are appearing in the currency of some countries which, because of their similar diameter with other coin denominations, cannot be successfully sorted by the traditional methods.

A second coin denomination B has a diameter significantly larger than that of a coin of denomination A but has a thickness dimension similar to denomination A.

The third denomination C is a coin which has a diameter slightly less than a coin of denomination A and a thickness dimension substantially less than denomination A.

Coin denominations B and C represent coins which have been successfully sorted by traditional methods, but which now must be sorted from a group of coins including a coin having the dimensions of a coin of denomination A. A detailed description of the movement of coin denomination A will be given in connection with FIGS. 3–8, denomination B in connection with FIGS. 8–10 and denomination C in connection with FIGS. 11–13.

Figure 1:
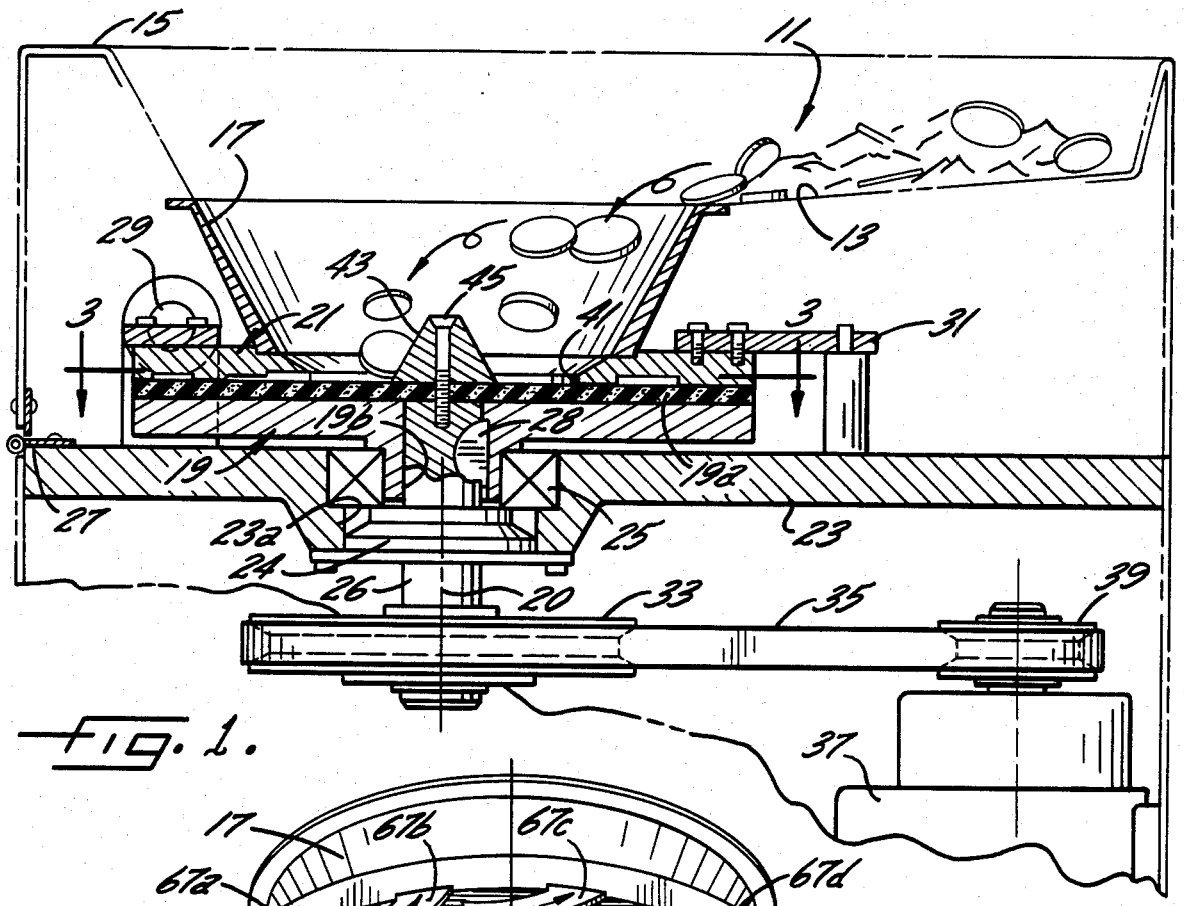
FIG. 1 is a cross-sectional view of a coin sorter machine which can utilize the coin sorter apparatus according to the invention.

Referring first to FIG. 1, a coin sorter machine is shown which might utilize the coin sorting apparatus according to the invention to rotate coins in an outwardly spiral orbit and eject each different denomination of coin from the sorting apparatus at a different selected location. To start the sorting process a collection of mixed denomination coins 11 is dropped onto a staging platform 13 which is an integral part of a housing cover 15. The coins 11 are manually pushed along the gentle sloping incline of the staging platform 13 and fall into a hopper 17 as indicated by the arrows in FIG. 1. The coins are directed by the hopper 17 into the coin sorter apparatus which is comprised of a rotating disk 19 and a stationary disk 21, shown in cross-section in FIG. 1. The stationary disk 21 contains recesses and ridges on its bottom surface whose purpose will be explained in greater detail in conection with FIGS. 2–13.

A resilient pad 19*a* provides the top surface for the rotating disk 19. This pad 19*a* is firmly secured to the disk 19 and, therefore, rotates along with the disk 19 about its center axis 20. Because the rotating disk and stationary disk are held closely together, coins which rotate on the resilient pad 19*a* are brought into the region between the disks and selectively pressed into the pad by the stationary disk's ridges and recesses. As a result, the rotating coins are selectively allowed to move outwardly to the disk periphery in response to centrifugal force. Each denomination of coin reaches the periphery at a different location relative to the stationary disk. Therefore receptacles can be fixed at these locations to catch the sorted denominations.

Since coins are alternately pressed into and released from the pad, the pad 19*a* should be a rubber composition with a resilience of about 30 to 35 durometers. The stationary disk may be formed by machining a preheated steel core and then surface treating the disk for additional hardness by a well known gas nitriding process. Support for the sorter apparatus is provided by a base 23 which has a opening 23*a* that receives a drive shaft section 19*b* of the rotating disk 19. To allow the rotating disk 19 to turn relative to the stationary base 23, a bearing 25 is fitted between the shaft section 19*b* of the rotating disk 19 and the opening 23*a* of the base 23. To relieve the bearing 25 of the weight of the coin sorter apparatus, a collar and support plate 24 are mounted at the bottom mouth of opening 23*a*.

A drive shaft 26 with a slotted key 28 extends from the drive shaft section 19*b* of the rotating disk through the collar and support plate 24. To turn the drive shaft 26 a pulley 33 is attached to the drive shaft bottom end. The pulley 33 is connected by a belt 35 to a motor 37 which also has a pulley 39 at the end of its drive shaft. The belt and pulley drive acts like a clutch mechanism by allowing the belt to slip on the pulleys in the event that coins jam between the rotating disk 19 and the stationary disk 21.

To facilitate maintenance and repair, the housing cover 15 is hinged to the base 23 by hinge 27 and the stationary disk 21 is attached to the base 23 by way of hinge 29. On the opposite side of the stationary disk from the hinge 29 is a support structure 31 which supports the stationary disk 21 in horizontal alignment over the rotating disk 19 and also provides a handle to lift the stationary disk 21 about the pivot 29. The support structure 31 and pivot 29 also fix the vertical position of the stationary disk 21, holding it close to the surface of the resilient pad 19*a* but not touching it. This avoids any possibility of degradation of the resilient pad surface through frictional wear against the stationary disk.

As can be seen in the cross-section of FIG. 1, the stationary disk 21 has a central opening 41 which exposes a portion of the resilient pad 19*a* such that coins dropped from the hopper 17 land onto the resilient pad 19*a* of the rotating disk 19. Because the coins tend to move on the rotating disk in a spiraling orbit, the central opening 41 is annular in shape in order to allow for this natural movement. To prevent bunching of the coins in the center of the exposed portion of the resilient pad 19*a*, a conical projection 43 is secured by a screw 45 to the rotating disk 19 at the rotational center of the disk.

When the coins are dropped onto the exposed central surface portion of the rotating disk 19, they react to the centrifugal force imparted on them by the rotating disk by moving toward the annular side wall of the central opening 41 cut in the stationary disk 21. Simultaneously and in combination with this outward movement the coins are carried by the rotating disk 19 in an orbit about the disk's rotational center. Together these movements describe an outwardly spiraling orbit as viewed from the perspective of a stationary observer. When a coin's edge reaches the annular side wall of the central opening, its outward movement is restrained by the annular side wall.

The annular side wall of the central opening includes a recess which allows single coins, but not multiple layered coins, to slide under the stationary disk. As will be explained in greater detail in connection with FIG. 2, coins which slide into the recess are captured between the two disks by a series of ridges and recesses in the stationary disk and are guided by these ridges and recesses to predetermined destinations which are different for each coin denomination. Due to cooperation between the resilient surface of the rotating disk and the ridges and recesses of the stationary disk, the coins radial movements are, in part, guided by alternately pressing the coins into the rotating disk and releasing them as the rotating disk carries the coins in an orbit under the stationary disk. As a compliment to this, edges composed of junctions between ridges and recesses guide the orbit of the coins by creating barriers to the radial movement of the coins. The recesses and ridges of the stationary disk are strategically positioned along the rotational path of the coins so as to utilize the centrifugal force imparted on the coins by the rotating disk in such a way as to sort the coins by denomination.

Figure 2:
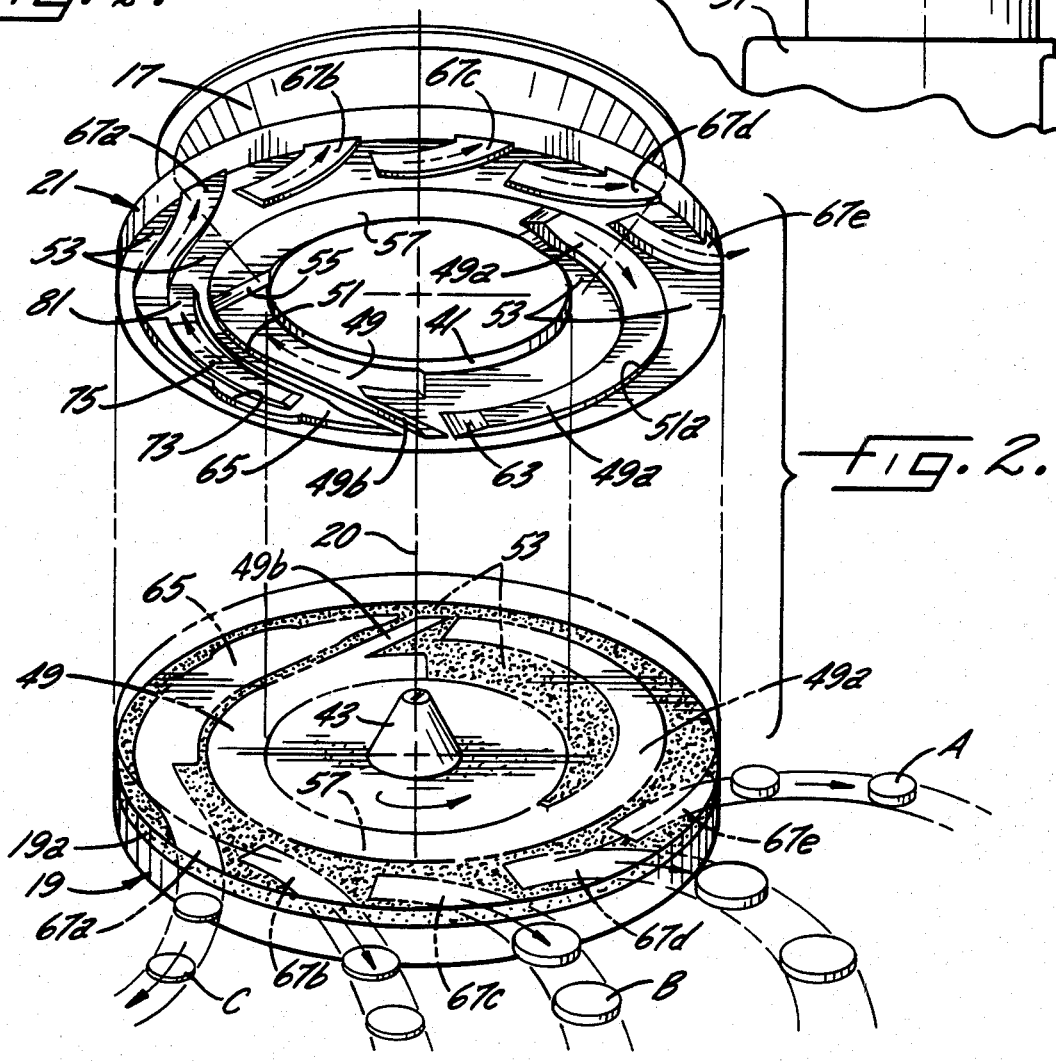
FIG. 2 is a exploded perspective view of the stationary and rotating disks which comprise the coin sorter apparatus showing the surfaces of the two disks which in operation are located in close proximity.

Referring to FIG. 2 which shows an exploded perspective view of the two disks 19 and 21, coins of at least denominations A, B and C are rotated on the rotating disk 19 and resilient pad 19*a* in a path generally described by the unshaded areas on the pad surface. The pad is a flat planar surface while the stationary disk surface which is proximate to the pad forms predetermined patterns of recesses and ridges. A ridge region 53 is parallel with the surface plane of pad 19*a* and occupies a large portion of the underside of the stationary disk. In order to press coins into the resilient pad, this coplanar ridge region is the stationary disk surface closest to the surface of the rotating pad. But the ridge region 53 does not touch the rotating resilient pad since direct contact by the stationary disk would degrade the pad surface. In order to illustrate the region where all coin denominations are pressed into the pad (i.e., when coins are under ridge 53) the region where ridge 53 is located over the pad surface is indicated by the shading on the pad in FIG. 2. The arrows in the ridges and recesses in the underside of the stationary disk 21 show the direction of movement of the coins in the recesses. To further ease understanding of the invention, ridges and recesses located at different areas on the surface of the stationary disk, but having a coplanar surface, have been identified by a common numeric designation and an individual alpha designation (e.g., 49, 49*a*, 49*b*).

A useful way to describe the functional interrelationship of the rotating disk and stationary disk is to view the stationary disk as a camming mechanism. If the stationary disk were removed from its position proximate to the surface of the rotating disk, coins placed on the rotating disk would exhibit an orbital path having a constant radial component as a result of the unhampered centrifugal force acting on the coins. As a result the coins would be flung off the rotating disk surface in a haphazard manner. The stationary disk serves to controllably cam the radial movement of the coins and thereby impart to the coins a controlled orbit which steadily increases. While on route in this controlled outwardly spiraling orbit or arcuate path, the coins are sorted by the camming action of the stationary disk.

Each area of ridges and recesses in the stationary disk cams the coins in a particular manner to prepare the coins for the journey to, and manipulation by, a following area of ridges and recesses. The ridges and recesses in the surface of the stationary disk provide two types of camming action. In the first type of camming an edge or side wall, defined by a combination of a ridge and recess, serves as a guide surface for the edges of the coins which are urged against the side wall by centrifugal force. In the second type of camming a recess is cut in the stationary disk to a depth which is greater than the thickness of some denominations of coins and less than the thickness of other denominations of coins. Accordingly some denominations are actively cammed and their radial movement prevented by being pressed into the pad by a recess too shallow for the coin thickness. Other denominations are passively cammed by the same recess since they are thinner than the recess depth and, therefore, are allowed to move radially.

When coins are brought into one of the second type of camming area of the stationary disk by way of the rotating disk, the denominations of coins which have a thickness greater than the depth of the recess stay pressed into the resilient surface of the rotating disk. Consequently, the thicker coins do not move relative to the surface of the resilient pad 19*a* and the rotating disk 19. But relative to the stationary disk 21 these thicker coins move in an orbit about the center of the rotating disk without changing their radial distance from the center. Those denominations of coins which have thicknesses less than the depth of the recess are not pressed into the resilient surface of the rotating disk and are therefore free to move radially outward from the rotating disk center. These thinner coins move radially outward until they meet an edge or side wall of a recess in one of the first type of camming areas of the stationary disk. By selective camming of the coins by the stationary disk in the two ways mentioned, the coins are carried in an outwardly spiral orbit on the resilient surface of the rotating disk which segregates the coin by denomination as will be explained more fully in connection with denominations A, B and C in FIGS. 3–13.

As the coins are carried on the rotating disk their path comprises two well defined movements between the surface of the stationary disk and the rotating disk. If the coins are kept pressed into the pad by the ridges and recesses of the stationary disk, the coins will not move radially under the influence of centrifugal force but will be carried on the resilient pad at a constant radius to define a circular orbital path about the center of the rotating disk. If during their orbit the coins are brought into a recess in which the coins are not pressed into the pad, the coin will move outwardly on the pad in response to centrifugal force, thus giving the coin orbit a radial component which moves the orbit farther out from the disk center until the orbit's radial component is cammed by an edge of a ridge-recess combination in the stationary disk. As long as the coins are not pressed into the resilient pad 19*a* they will remain against the stationary disk edge as they continue to orbit. In short, the recesses and ridges in the bottom surface of the stationary disk take advantage of the natural movement of the coins as they orbit to position the coins at particular disk radii which align their orbits so that recesses in the stationary disk encountered by the rotating coins will selectively exit the coins from between the two disks.

As can be seen in FIG. 2, the stationary disk 21 has a recess 49 which first receives the coins under the surface of the disk. In order to insure that all denominations of coins enter the recess 49, the recess is deep enough to accept the thickest coin. The arrow in recess 49 indicates the direction of movement of the coins in the recess as caused by the counterclockwise rotation of the rotating disk 19. As the coins are accepted into the recess 49 they are being carried on the pad surface in an orbit about the center of the rotating disk while simultaneously moving radially over the pad surface toward the disk periphery. Radial movement of the coins is limited by the outer edge 51 of the recess 49. As the coins follow the edge 51, they rotate into a recess 57 by way of wedge 55 with the recess having a depth less than that of recess 49. It can occur that some of the thinner denomination coins enter recess 49 stacked upon one another. To ensure that only a single layer of coins is fed through the coin sorter apparatus, a wedge 55, which is a transition from recess 49 to recess 57, sweeps off coins which have entered recess 49 stuck to the top surface of another coins or bridged between an adjacent coin's top surface and the pad surface. The wedge 55, and the recess 57 following it, press most of the coin denominations into the pad in the process of sweeping their surface clean of other coins. The recess 57 needs to be sufficiently shallow to ensure the wedge 55 sweeps clean the thinnest denomination coin. As a consequence of this, some of the thicker denomination coins are pressed into the pad by the recess 57.

Figure 3:
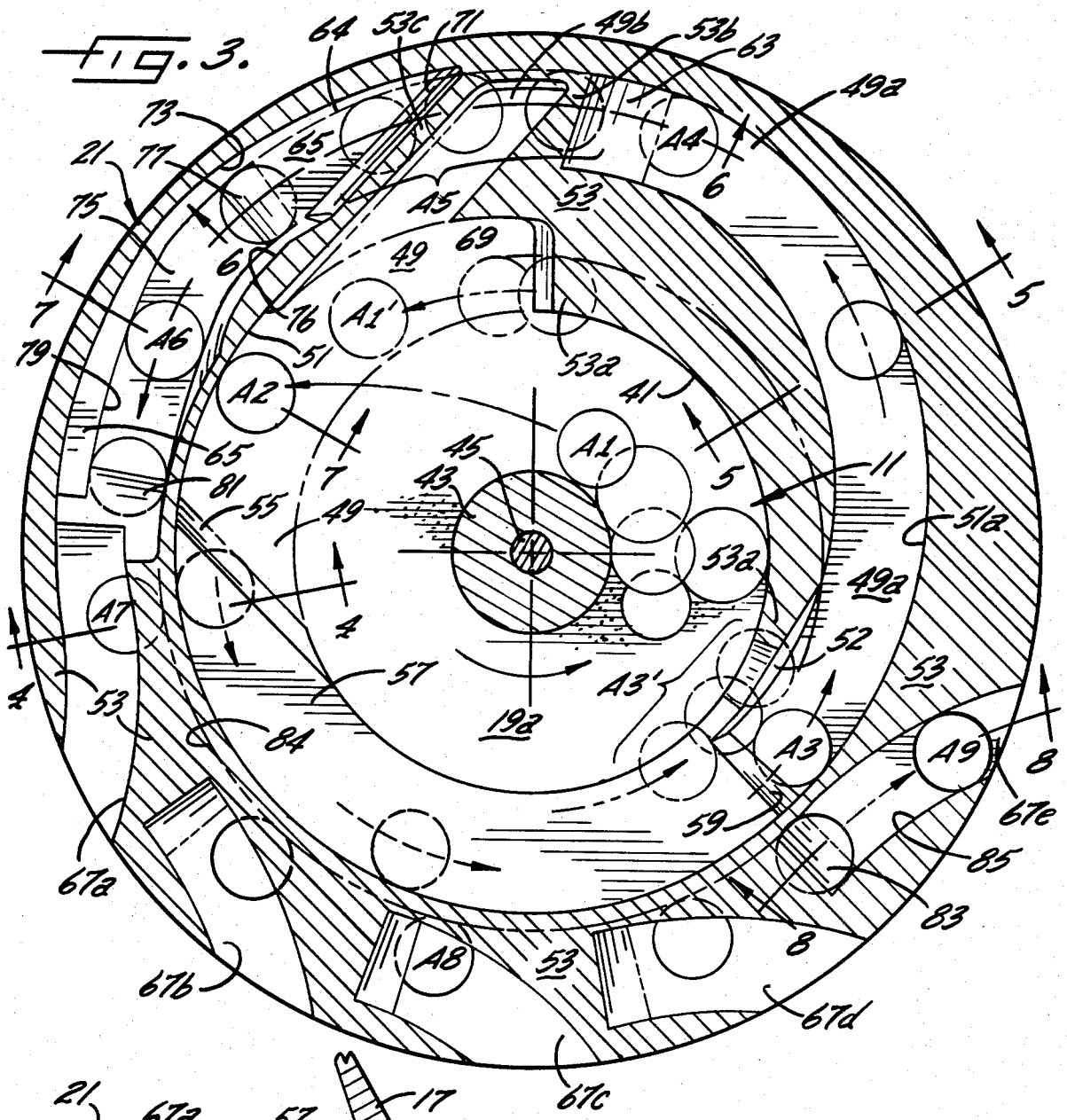
FIG. 3 is a full sectional view of the coin sorter apparatus taken substantially along the line 3—3 in FIG. 1 showing the movement of a coin of denomination A which is manipulated by thickness discrimination.

Coins are carried by the rotating disk 19 along the arcuate length of the recess 57 until the recess returns to the depth of recess 49*a* by way of ramp 59 (shown in FIG. 3). At this point, with portions of ridge 53 on either side of recess 49*a*, the recess and ridge form a channel which captures those coins which have been held by recess 57. Recesses 49 and 49*a* are deep enough to allow free radial movement for all denominations of coins. In the recess 49*a* the coins are again guided by edge 51*a* which adjusts the proper radial position of the coins. At the end of recess 49*a* the coins are again pressed into the resilient pad 19*a* by a wedge 63 which is an incline bridging the depth level of recess 49*a* with the ridge 53. As the coins are carried by the rotating disk 19, the coins are steadily pressed into the resilient pad 19*a* as the rotating coins are moved under the gradual incline of the wedge 63.

Further movement of the coins on the rotating disk 19 brings the coins under a recess 49*b*. This recess serves to re-cycle improperly aligned coins back to recess 49. The detailed description of the function of recess 49*b* will be given in connection with FIG. 11. Properly aligned coins will rotate past the recess 49*b* and enter recess 65.

As can be seen by comparing the unshaded area on the surface of the rotating disk 19 in FIG. 2 which corresponds to the recess 65 on the underside of the stationary disk, the recess 65 contains more than one depth level. Within the recess 65 is a recess 75 which cooperates with the recess 65 to radially manipulate coin position by using coin thickness as the discriminating parameter as will be explained in connection with FIGS. 3–13. The outer edge 73 of recess 65 has an arcuate shape with a portion of the edge 73 in the area proximate to the recess 75 describing a dip, exaggerated for illustration, in the arcuate shape, giving the edge in the area of the dip a greater radial distance from the disk center and thereby moving the edge away from the recess 75. The dip in the shape of the edge 73 insures the coins which are not intended to be received into the recess 75 are positioned at a radial distance safely away from the recess 75.

From the recess 65 the pad rotation carries the coins into an area of the stationary disk which has a series of recesses 67*a*–67*e* for allowing properly sized and positioned coins to exit from between the disks. Each of the recesses 67*a*–67*e* acts as an exit chute for a particular coin denomination by releasing that particular coin from pressed engagement with the pad 19*a*. After the coins have been released from the pad, they are free to move radially along the recess and exit into a coin receptacle.

Referring now to FIG. 3, the structure of the ridges and recesses of the stationary disk will be described in relation to the manipulation of a coin of denomination A as it rotates on the rotating disk 19 under the recesses and ridges of the stationary disk 21. As mentioned above, coins of denomination A are coins whose diameter dimension is similar to other coin denominations but whose thickness is greater than those other similar-diameter denominations. FIG. 3 shows the movement of a coin of denomination A on the surface of the pad through locations A1 through A9. To facilitate an understanding of the coin movement, the lowermost surface 53 of the stationary disk has been cross-hatched in FIG. 3 to serve as a reference plane for the recesses in the disk. The non-cross-hatched areas of the stationary disk correspond to recessed areas of various depths.

To begin its journey, a coin of denomination A is dropped from the staging area 13 and hopper 17 onto the resilient pad 19*a* of the rotating disk 19 at a location A1. Since the disk 19 and pad 19*a* are continuously rotating about axis 20 (shown in FIG. 1), the disk imparts a rotational movement to the coin, thereby causing centrifugal force to move the coin away from the center of rotation. As a result of this rotational movement, the coin follows an arcuate path similar to that shown by the arrow between locations A1 and A2 in FIG. 3.

Preferably, before coming into contact with the wedge 55 the coin A enters the recess 49 at location A2, and is radially positioned by the edge 51. As mentioned in connection with FIG. 2, the recess 49 is deep enough so that no denomination of coin therein is pressed into the resilient pad and, therefore, the coins therein are free to move radially. Between the end of the recess 49 and the beginning of the recess 57, the wedge 55 presses most denominations of the coins into the resilient pad, and thereby preventing radial movement of the coins.

Figure 4:
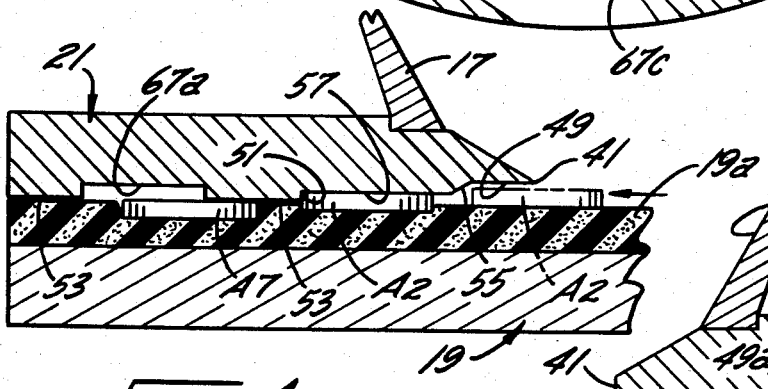
FIG. 4 is a cross-sectional view of the coin sorter apparatus taken substantially along the line 4—4 in FIG. 3.

Referring to FIG. 4, a coin of denomination A can be seen to be pressed into the resilient pad 19*a* when under recess 57. It can be seen that the coin has a thickness which is less than the depth of recess 49 and greater than the depth of recess 57. Accordingly, the coin is free to move radially when in recess 49, but is not free for radial movement when in recess 57. This pressed condition only exists for denomination A coins since wedge 55 must be able to ensure a single layer of coins for even the thinnest denomination.

Figure 5:
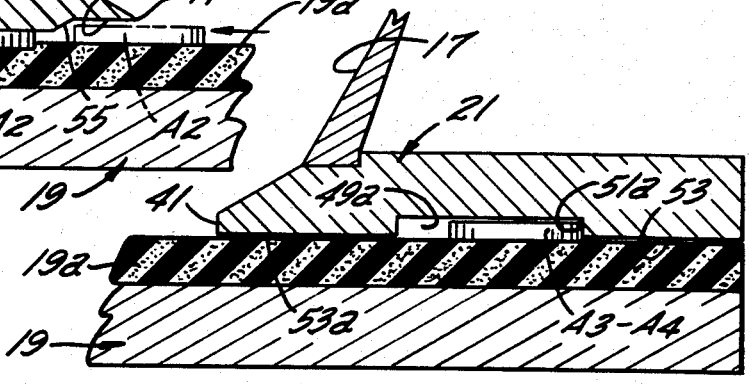
FIG. 5 is a cross-sectional view of the coin sorter apparatus taken substantially along the line 5—5 in FIG. 3.

Referring back to FIG. 3, as the rotating disk 19 rotates under the stationary disk the coin of denomination A is carried through the recess 57 to location A3 where the coin passes under a ramp 59 joining the recess 57 to recess 49*a*. Recess 49*a* has the same depth as recess 49, and therefore has a depth suifficient to not press the coins into the resilient pad 19*a*. Consequently the coins can move radially to the edge 51*a* which cams the edge of the coin to guide the coin along the recess 49*a*. Referring to FIG. 5 the coin of denomination A is shown in recess 49*a* with its edge being cammed by edge 51*a*.

If a coin of denomination A is not properly aligned by edge 51 before it is captured by recess 57, coins which are pressed into the pad by the recess will rotate with the rotating disk 19 and be intercepted by a segment 53*a* of the ridge 53. The three silhouettes of a coin of denomination A adjacent location A3′ in FIG. 3 illustrate the path of a coin which has not been properly aligned against edge 51. Ridge 53*a* presses the coin into the resilient pad 19*a* and prevents the coin from moving radially. The coin thus moves with the rotating disk under ridge 53*a* in a circular counterclockwise arc to where ramp 69 releases the coin into region 49*a* again; as described previously, recess 49 releases the coin from pressed engagement with the pad so that the coin is free to move radially toward edge 51. Location A1′ shows the coin released by ramp 69 will move radially outward under the influence of centrifugal force and will be guided by edge 51 which directs the coin movement into wedge 55 and recess 57. Now the coin is on the correct path to properly enter recess 49*b*.

Figure 6:
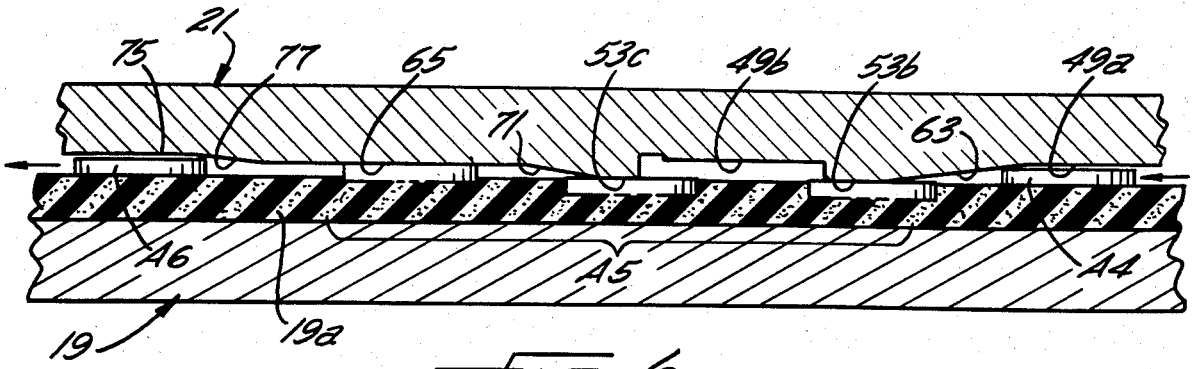
FIG. 6 is a cross-sectional view of the coin sorter apparatus taken substantially along the line 6—6 in FIG. 3.

Location A4 of the coin of denomination A as seen in FIGS. 3 and 6, shows the coin entering wedge 63 which gradually brings the coin into pressed engagement with the resilient pad 19*a* under ridge 53*b*. Since the coin is pressed into the pad, the coin cannot move radially in response to centrifugal force. Instead the coin follows a path described by a phantom-line arc 64 (in FIG. 3) of constant radius and the coin locations designated A5. Even though the coin passes partly through recess 49*b*, some portion of the coin is always in contact with the ridges 53, 53*b* or 53*c* (the cross-hatched area). Accordingly, the coin is pressed into the resilient pad throughout its A5 locations. As the coin is held pressed into the pad by the ridge 53, the coin rotates along arc 64 into recess 65. The transition between ridge 53*c* to recess 65 is a ramp 71, as can be seen more clearly in FIG. 6.

In FIG. 6, the coin location A4 illustrates the recess 49*a* has a depth greater than the thickness of a coin of denomination A and, therefore, radial coin movement can occur. The transition wedge 63 begins pressing the rotating coin into the resilient pad 19*a*, and the ridge 53*b* continues the pressure on the coin and thus prevents radial movement. The coin will stay pressed into the pad through its travel under the recess 49*b* since, as can be seen in FIG. 3, when properly aligned in the recess 49*a* a coin surface will not entirely free itself of the ridge 53 while being carried under the recess 49*b*. From the recess 49*b*, the ridge 53*c* again appears across the entire diameter of the coin A. Further rotation of the disk brings the coin into the recess 65 by way of a transition ramp 71.

Since coins of denomination A are the thickest of the similar diameter coins, the recess 65 is made to have a depth less than the thickness of the A denomination in order to press the coins into the resilient pad and not allow them to move over the pad surface. With coins of denomination A held in place, the rotating disk carries the A denomination coins along the arc 64 and into the recess 75 by way of a ramp 77, where the recess depth is deeper than the thickness of the coin. Now the A denomination coin within the recess 75 is free to move radially and accordingly is radially manipulated by edge 79 of the recess 75 as shown in FIG. 3 (position A6).

Figure 7:
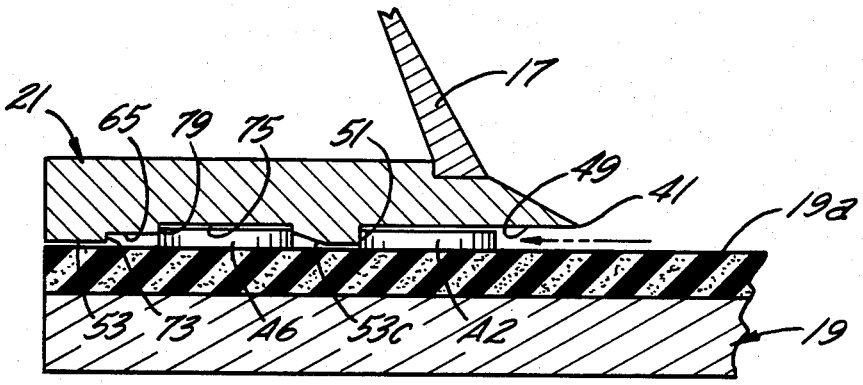
FIG. 7 is a cross-sectional view of the coin sorter apparatus taken substantially along the line 7—7 in FIG. 3.

In accordance with the invention recess 65 has a depth which is less than the thickness of a coin of denomination A but greater than the thickness of other denomination coins of similar diameter, thereby causing a coin of denomination A to be held pressed into the resilient pad by the recess 65 while other denomination coins of like diameter but lesser thickness are not pressed into the resilient pad. As a result, the latter coins move radially outwardly against the side wall 73. Since the recess 65 holds coins of denomination A pressed into the resilient pad, the coin follows its rotational path along the arc 64, bringing the coin into the recess 75 by way of the wedge 77. As seen in FIG. 7, the recess 75 is sufficiently deeper than recess 65 so that coins of denomination A are not held pressed into the resilient pad. Accordingly, the outer edge 79 of the recess 75 positions the coins of denomination A captured within the recess to a radial position spaced inwardly from that of the coins of other denominations which are free to move radially outward in recess 65 to edge 73.

The recess 75 leads a coin of denomination A to wedge 81 which forms a transition from recess 75 to ridge 53. Because of the particular radial position imposed on coins of denomination A by recess 75, the coin does not become entirely free of ridge 53 (which prevents radial coin movement) until the coin reaches ramp 83 and recess 67*e* which are radially positioned to capture coins from recess 75 and release them from their pressed engagement with the resilient pad. The recess 67*e* allows the coins to escape from the area between the disks by moving radially, as can be seen at location A9 in FIGS. 3 and 8. The constant radius arc 84 traces the path of coins of denomination A under the recess 53 as the resilient pad moves the coin from location A7 to the recess 67*e* and location A9.

Referring to FIG. 7, coin location A6 shows the recess 75 to have a depth greater than the thickness of a coin of denomination A while the depth of recess 65 is slightly less than the thickness of the coin. By following the edge 79, the radial movement of a coin of denomination A is cammed inwardly by the contour of the edge 79. In addition, FIG. 7 shows the coin position A1′ which corresponds to the position of a coin of denomination A located against the edge 51 and under recess 49.

Location A7 shows a portion of a coin of denomination A under a portion of ridge 53 and thus being pressed into the resilient pad. As long as the coin is pressed into the pad it will be carried on the pad at a fixed location and will rotate under the recesses and ridges of the stationary disk at a constant radial position as determined by the last recess in which the coin was allowed to move radially (recess 75). The cross-section in FIG. 4 shows a coin of denomination A at coin location A7 pressed into the resilient pad 19*a*. At location A8, since a portion of the coin surface is still under ridge 53, the coin remains pressed into pad 19*a* even though a large part of the coin is within recess 67*c*. As long as the coin has any portion of its surface under ridge 53 it is restrained against radial movement so that it follows an orbit 84 of constant radius about the center of the rotating disk 19 and its resilient pad. In this orbit, a coin of denomination A is carried under ramp 83 which is the transition between ridge 53 and recess 67*e*. The radial position defined by the orbit 84 places the path of the coin entirely within the recess 67*e*. Now a coin of denomination A is no longer held pressed into the resilient pad by ridge 53 and, since recess 67*e* is deeper than the thickness of the coins of denomination A, the coin is free to move radially, following the edge 85 as shown by coin location A9. All coins of denomination A are collected in a receptacle which catches the coins as they leave the region between the two disks by way of recess 67*e*. If desired, a mechanical or electrical counter can be fixed proximate to the exit of the coins in order to detect and count the number of coins sorted.

Figure 8:
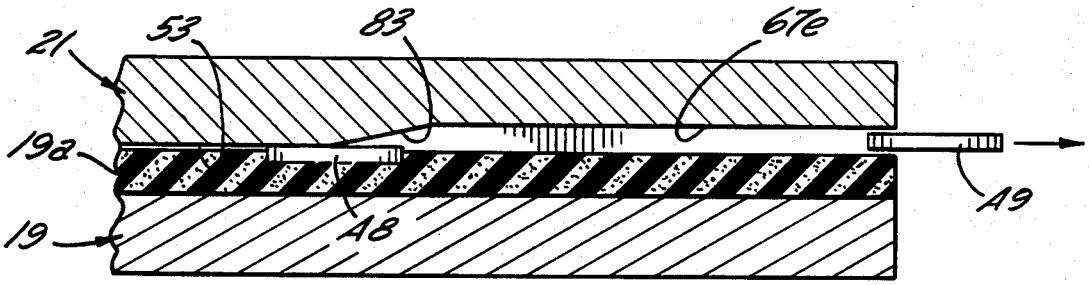
FIG. 8 is a cross-sectional view of the coin sorter apparatus taken substantially along the line 8—8 in FIG. 3.

Referring to FIG. 8, a coin of denomination A is shown at coin locations A8 and A9 which correspond approximately with the same locations in FIG. 3. As the coins of denomination A rotate under the ridge 53 they are carried into the ramp 83 which is a transition region between the ridge 53 and the recess 67*e*. Further movement of the resilient pad 19*a* and rotating disk 19 carries the coin into the recess 67*e* which has a depth greater than that of coins of denomination A, therefore allowing the coin to exit the region between the two disks as indicated by location A9.

Figure 9:
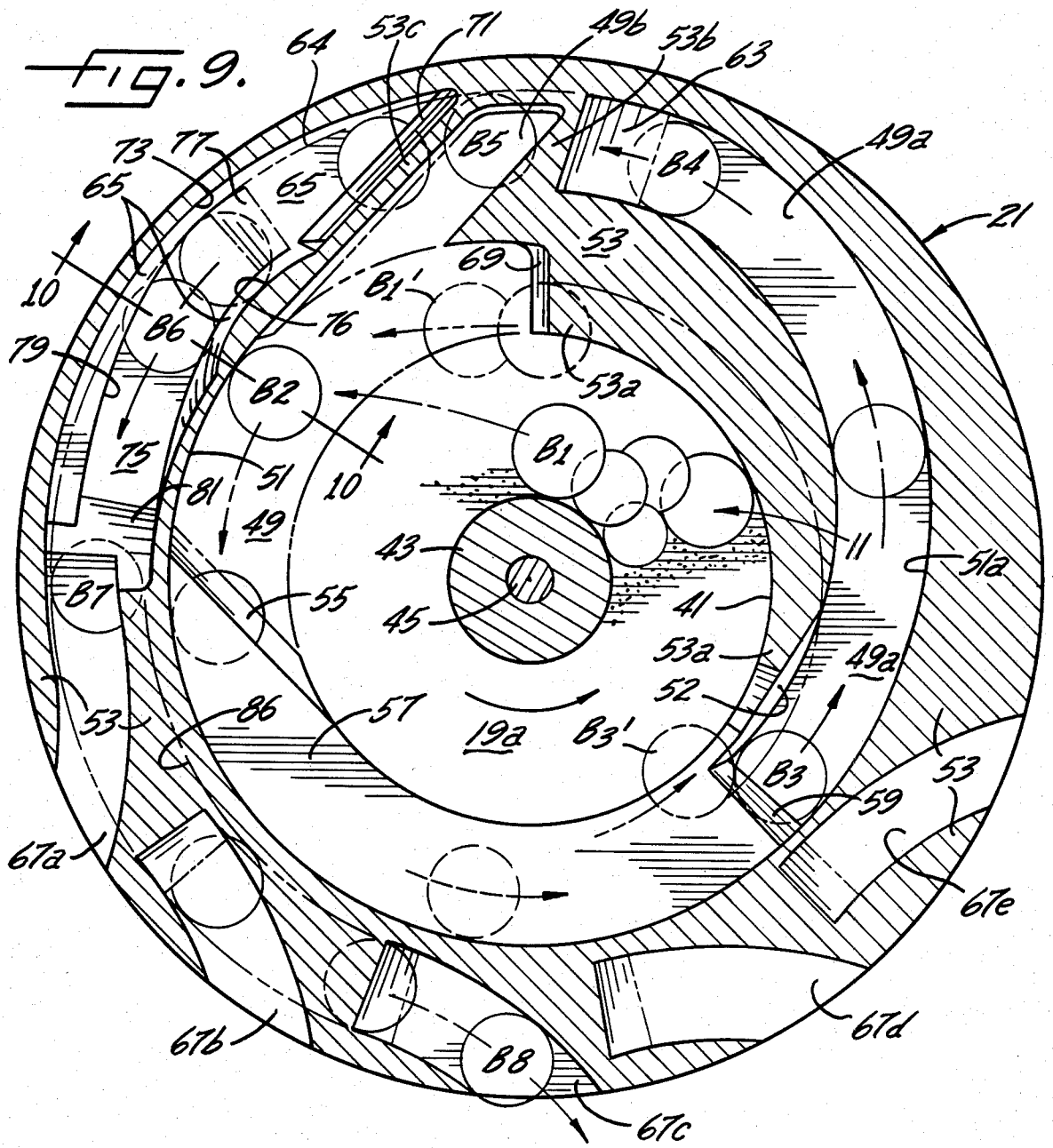
FIG. 9 is a full sectional view of the coin sorter apparatus taken substantially along the line 3—3 in FIG. 1 showing the movement of a coin of denomination B which is manipulated both by thickness discrimination and by diameter discrimination.

FIG. 9 shows the denominational sorting of a coin of denomination B as it rotates on the resilient pad and travels under the recesses and ridges of the stationary disk. Locations B1 through B8 are identified to illustrate and clarify the treatment of the coin by the sorter apparatus. Coins of denomination B have a larger diameter than coins of denomination A but have similar thicknesses. As will become clear from the discussion below, coins of denominations B are manipulated quite differently than coins of denomination A.

The coins 11 in FIG. 9 begin their journey in the same manner as explained in connection with FIG. 1. As the coins hit the surface 19*a* of the rotating disk, they are immediately imparted with a rotational movement. As explained in connection with FIG. 3, the coins experience movement from centrifugal force which causes the coins to generally move outwardly from the rotational center as is indicated by the arrow from coin denomination B location B1 to B2.

As locations B3 and B4 suggest larger diameter coins, like those of denomination B, have their inside edges in close proximity to the inside edge of recess 49*a*. To ensure these larger diameter coins do not get stuck against the inside edge of the recess (becuase of the slight wedging action caused by the recess edges being slightly less than vertical) the inside edge of recess 49*a* includes a bulged area 52. This bulged area gives enough room in the recess 49*a* for the larger diameter coins to succumb to the centrifugal force and move to the outside edge 51*a* of recess 49*a*.

Movement of the coin denomination B from location B3 to location B4 is exactly the same movement as that described for coin denomination A in its movement between locations A2–A4. The recess 49 (areas 49*a* and 49*b* included) is deep enough to freely accept coins of denomination B, while recess 57 is shallow enough that these denominations are pressed into the pad. Except for bulge 52 the coins of denomination B receive the same manipulation by the recesses between locations B2–B4 as did coins of denomination A, therefore, the movement of the coins through these locations will not be repeated. If a coin of denomination B is not properly aligned to enter the recess 49*a*, the radially innermost ridge 53*a* will press the coin into the pad, as shown at location B3′, and return it to the recess 49 in the same manner described in connection with coins of denomination A. A silhouetted coin is shown at location B1′ in FIG. 9 to illustrate the path of misaligned coins of denomination B.

At location B5, the coin is rotated through the recess 49*b* but is maintained pressed into the resilient pad by a portion of ridge 53 which is always over a portion of the coin as it passes through recess 49*b*. This is the same coin movement which coin denomination A describes through recess 49*b* as indicated by location A5 in FIG. 3. As a coin of denomination B passes under ridge 53*c* and enters recess 65 it is still maintained in pressed engagement with the resilient pad 19*a* since its thickness is similar to that of coin denomination A. Since the coin is pressed into the resilient pad, it cannot move radially and, therefore, is carried on the resilient pad at the same radial distance at which it was positioned by recess 49*a* (defined by arc 64 in FIG. 9).

Figure 10:
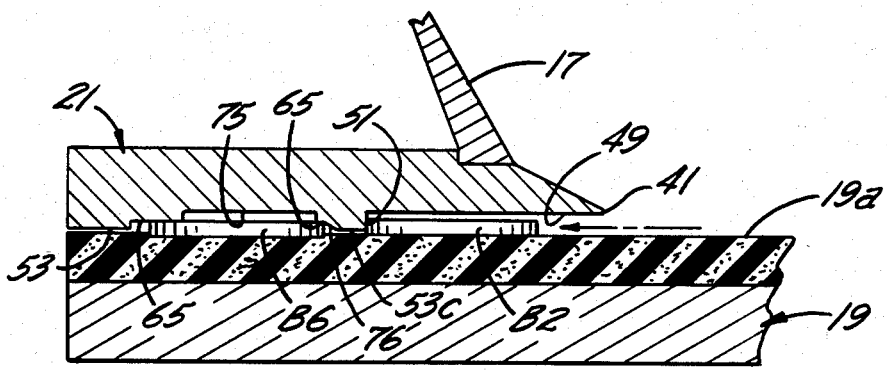
FIG. 10 is a cross-sectional view of the coin sorter apparatus taken substantially along the line 10—10 in FIG. 3.

Continued movement of the coin along the arc 64 to location B6 does not result in the capture of the coin in the recess 75, since coins of denomination B have a diameter which is too large to fit within the recess 75. Therefore, the coin B straddles recess 75 and is not radially manipulated by its edges. This can be clearly seen in FIG. 10 which shows location B6 in cross-section. Opposite edges of the coin at location B6 are supported by recess 65 thus keeping the coin out of recess 75. FIG. 10 also shows a coin of denomination B entering the recess 49 either from location B1 in FIG. 9 or exiting from ridge 53*a* at location B1′ after being initially misaligned for entry into recess 49*a*.

Coins of denomination B are helped into a position straddling recess 75 by edge 76 in FIG. 9 which acts to push the coin radially outward in order to avoid the outside edge of coin B from slipping into the recess 75. In order to avoid the jamming of a coin whose outer edge has slipped into the recess 75 and whose inner edge is against edge 76, the edge tapers into a ramp in the area proximate to location B6. If the outer edge of a coin of denomination B has slipped into the recess 75, the ramp portion of edge 76 ensures the coin inner edge will not be jammed as edge 79 of recess 75 guides the coin radially inwardly. The ramp portion of edge 76 gives a coin B, with its outer edge trapped in recess 75, enough room to drop its outer edge out of the recess so it may move radially to its correct position against edge 73.

As can be seen by following the path 86 of coin denomination B through locations B7 and B8 in FIG. 9, the coin is carried on the rotating disk at a constant radial distance since either recess 65 or ridge 53 is always pressing the coin into the disk pad until the coin passes under recess 67*c*. This recess has its opposite edges far enough apart to accept the diameter of a coin of denomination B whereas recesses 67*a* and 67*b* were not wide enough to accept the entire coin diameter. Accordingly, the recess 67*c* releases the coin from its pressed engagement with the resilient pad, and the edges of the recess 67*c* guide the coin out from between the two disks. Ordinarily, as with coins of denomination A, the coin is received in a receptacle adjacent the outer end of the recess 67*c* to complete the sorting task.

Figure 11:
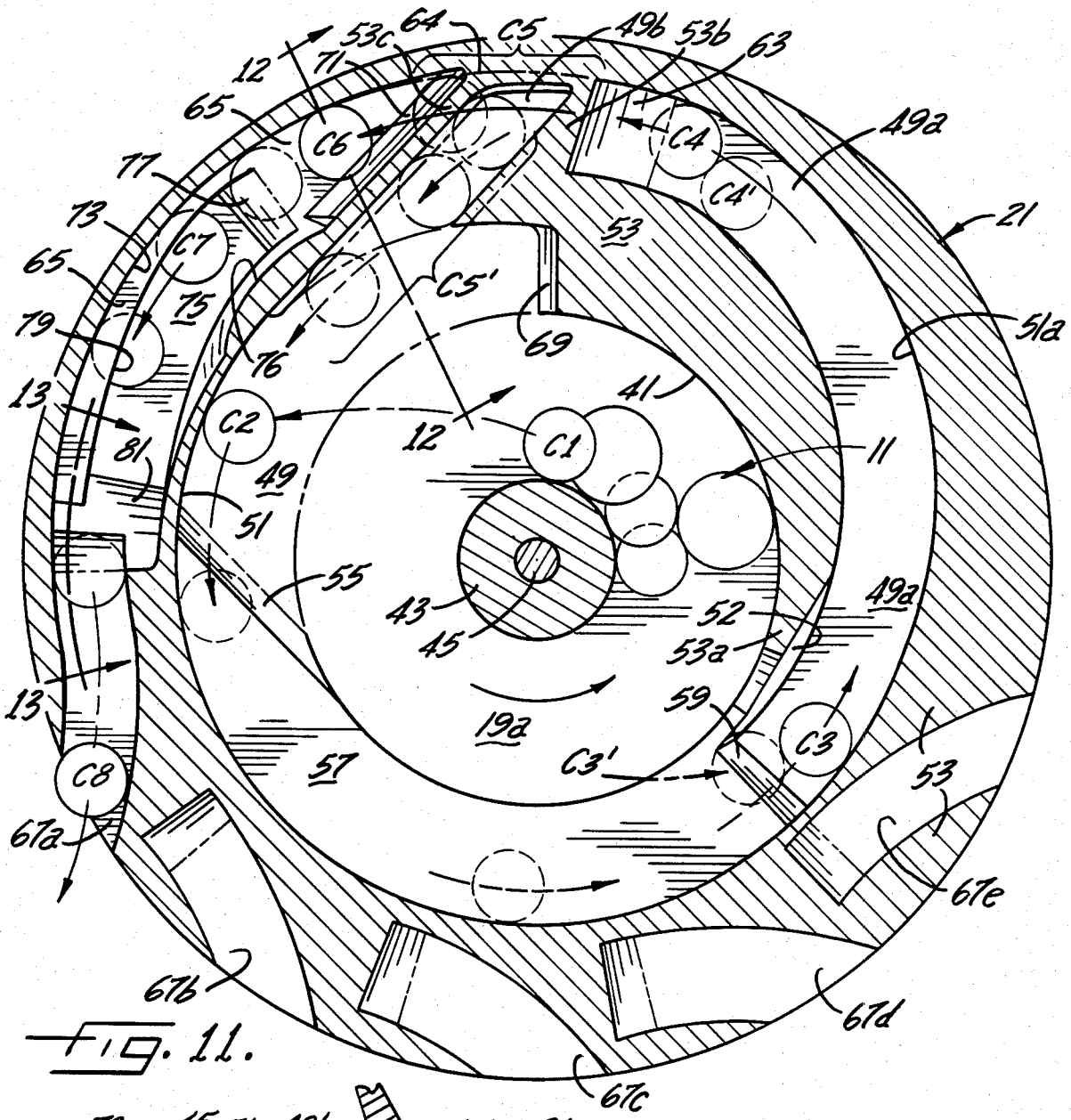
FIG. 11 is a full sectional view of the coin sorter apparatus taken substantially along the line 3—3 in FIG. 1 showing the movement of a coin of denomination C which is actively manipulated by diameter discrimination and passively manipulated by thickness discrimination.

FIG. 11 shows the movement of a coin of denomination C through locations C1 to C8. A coin of denomination C represents a coin of slightly smaller diameter than a coin of denomination A and of significantly lesser thickness. Because of its small diameter, a coin of denomination C can fit into the recess 75 whereas a larger diameter coin such as one of denomination B could not. Therefore, the sorter apparatus must manipulate coins of a character like denomination C in a manner different than that of denomination B. As explained below, the recess 65 does not press the coins of denomination C into the resilient pad, thereby allowing these coins to move radially to the outer edge 73 of the recess 65.

Movement of a coin of denomination C through positions C1 to C4 is substantially the same as that described above for coin denominations B and A and will not be repeated in detail. But, in connection with the movement of coin denomination C from location C1 through C4, FIG. 11 shows a possible misaligned coin at C3′ and C4′ which, because of the coin's relatively small diameter, may not be caught by the ridge 53*a*, as were denominations A and B, and yet may be misaligned against the outside edge of the recess 49*a*. At either coin location C3′ or C4′, adjacent coins could prevent the coin from moving out radially to meet the outer edge of the recess 49*a*. If this misalignment were not corrected, the coin could be led into the recess 65 along a different arc path than that of arc 64, which could result in the coin improperly exiting from one of the recesses 67*a*–67*e* or possibly not exiting at all and jamming the machine.

To solve the misalignment problem characterized by locations C3′ and C4′, a recess 49*b* (the same depth as 49 and 49*a*) is provided along the path of the coins as they pass out of recess 49*a*. The misaligned coin at location C4′ will be pressed into the resilient pad 19*a* by wedge 63 and held in pressed engagement with the pad by the ridge 53*b*. Correctly aligned coins will also be pressed into the pad by the wedge 63 and ridge 53*b*, and they will be kept pressed into the pad by the ridge 53*c* as they pass along arc 64 at location C5, just as did correctly aligned coin denominations A and B. Since misaligned coins are located at a radial position spaced inwardly from that of correctly aligned coins, the outer edges of the former do not stay under a portion of ridge 53. Therefore, the misaligned coins are released from a pressed engagement with the resilient pad 19*a* by the recess 49*b*. Once the coins are released from the pad they are free to move radially, as shown by location C5′, and the outside edge 51 of the recess 49*b* cams the coins back into recess 49 for another attempt at proper alignment within recess 49*a*.

It should be noted that coins of denomination C are not the only coin denominations which can be misaligned in recess 49*a*. Any coin denomination of a diameter less than the width of the recess 49*a* can experience the same problem. As an example, coin denomination A could be misaligned in recess 49 and as a result be captured by recess 49*b* and returned to recess 49. In practice, the larger the diameter of a coin, the less likely the coin is to be misaligned in recess 49. In fact, experience indicates that only small diameter thin coins, like those of denomination C, are misaligned in recess 49*a*. Therefore, the width of recess 49*b* is required only to be sufficient for small diameter coins. The rare occurrence of misalignment of the larger diameter coins is always limited to a small misalignment since the larger diameter leaves less room in recess 49*a* for these coins to be radially displaced. Consequently, the ramp 71 and edge 76 help to correct these small misalignments of the larger coins by urging their position radially outwardly to the edge 73.

Figure 12:
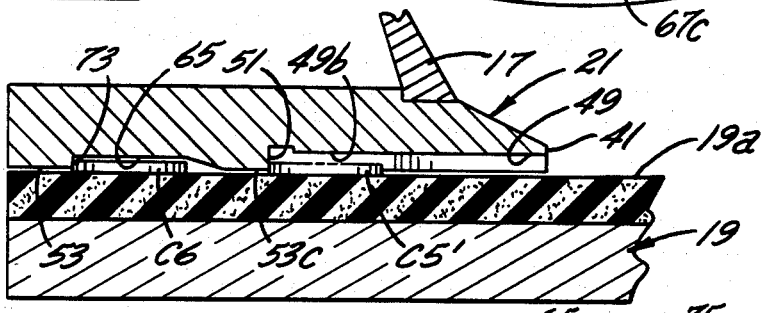
FIG. 12 is a cross-sectional view of the coin sorter apparatus taken substantially along the line 12—12 in FIG. 11.

FIG. 12 shows the location C6 of a correctly aligned coin in recess 65 and the location C5′ of a misaligned coin in recess 49*b*. It can be seen that the depth of recess 49*b* is deeper than the depth of recess 65. Consequently, the recess 49*b* will release all denominations of coins, whereas recess 65 will allow only certain denominations to be released. FIG. 12 also clearly shows that the coin denomination C is one of those denominations which recess 65 releases from pressed engagement with the resilient pad, thus allowing the coin to move radially over the pad surface.

Since the coin denomination C is free to move radially in recess 65, the coin will not follow arc 64 as did coins A and B. Instead, the coin C will, in response to centrifugal force, move outwardly to the edge 73 of the recess 65. The edge 73 guides the C-denomination coins away from recess 75. If the coins were not guided away from the recess 75, but instead stayed on arcuate path 64, the C-denomination coins would be carried into recess 75 because their diameter is less than the width of the recess; as a result, the coin would be radially manipulated by the recess 75 in the same manner that coins of denomination A are manipulated. Consequently, the C-denomination coins would be captured by recess 67*e* which captures denomination A coins.

Figure 13:
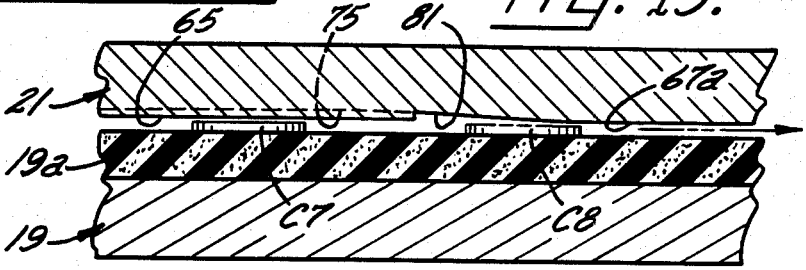
FIG. 13 is a cross-sectional view of the coin sorter apparatus taken substantially along the line 13—13 in FIG. 11.

To ensure that coins of denomination C do not enter recess 75, the edge 73 of recess 65 which guides the C-denomination coins increases its radial distance from the center of the rotating disk in the area surrounding coin location C7. As the edge 73 guides or cams the C-denomination coins toward wedge 81 beyond position C7 the radial position of the edge 73 gradually decreases. This decrease in the radius of the edge 73 brings the coin C back to the proper radial position, in preparation for its release by recess 67*a*. FIG. 13 shows how coins of a denomination C are released from pressed engagement with the resilient pad 19*a* by recess 65 (location C7), thus giving the coins the ability to move radially on the pad and be carried clear of recess 75 (shown by a dotted line in FIG. 13). The edge 73 of the recess 65 radially positions the coins so they are carried directly into the recess 67*a*, which has a depth which frees the coin from the pad and a width which frees the coin from ridge 53 (see FIG. 11 at location C8). If coin denomination C were slightly larger in diameter but of the same thickness, the coin would be wedged into the resilient pad 19*a* and held there by ridge 53 because the larger diameter would cause a portion of the coin to pass under ridge 53. The coin would then rotate with the pad until it reached a recess, such as 67*b*, with the proper radial position and width to release the coin from between the two disks.

For example, coin denomination B, although manipulated differently than coin denomination C in recess 65, nevertheless is cammed by edge 73 before it is pressed into the rotating pad by wedge 81 and ridge 53 to be carried to recess 67*c*. Since both denominations B and C have their outer edges cammed to the same radial distance by edge 73, it is only the coin inner edge which is at a unique radial distance for each denomination (B and C). Therefore, for those denominations which are radially aligned by edge 73, the associated recesses which allow the different coins to exit from between the disks must be arranged on the stationary disk so that the coins pass under them in an order of ascending width. To accomplish this, as the sectional views in FIGS. 3, 9 and 11 show, the recesses 67*a*–67*d* are aligned in a counterclockwise order of ascending width. The last recess 67*e*, which releases coins of denomination A, is shown as being sequentially last even though it has a width less than that of some of the preceding recesses. Recess 67*e* can be placed last since both the inner and outer edge of coins of denomination A are placed at unique radial positions by the recess 75. That is, coins of denomination A do not share a common radial position of their outer edges as do the other denominations which are cammed by edge 73. So even though recesses 67*c* and 67*d* are wider than recess 67*e*, the latter recess can be placed after the other recesses and still successfully release coins of denomination A.

In summary, coins A, B and C, because of their different sizes, are each manipulated in a different manner by the ridges and recesses of the stationary disk as the coins are carried under the stationary disk on the resilient pad surface of the rotating disk. As a result, the coins exit from the area between the two disks at unique locations along the stationary disk periphery. A coin of denomination A, which heretofore could not be successfully sorted, can now be sorted from other coin denominations by discriminating between the thickness of a denomination A coin and other coin denominations.

I claim:

1. A coin sorter apparatus for sorting coins by denomination using coin thickness as a discriminating parameter, said apparatus comprising:

a rotating disk having a first resilient surface for receiving a mixed denomination of coins and imparting a rotational movement to said mixed denomination coins;

a stationary disk having its underside parallel with said first resilient surface of said rotating disk with ridges and recesses on the stationary disk underside to selectively direct the rotating mixed denomination coins into a region between the two disks, first selected areas of the ridges and recesses in said stationary disk allowing coins of distinct thicknesses to occupy distinct radial positions on said rotating disk as the coins on said rotating disk rotate beneath said stationary disk, second selected areas of the ridges and recesses in said stationary disk which cooperate with said first selected areas to allow centrifugal force to radially move the coins along the surface of the rotating disk and exit from between the two disks at distinct points of coin rotation for each denomination of coin.

2. A coin sorter apparatus as set forth in claim 1 wherein said first selected areas of the ridges and recesses includes certain ridges which press coins greater than a predetermined thickness into the resilient surface of said rotating disk and releases to the effect of centrifugal force coins of lesser thickness.

3. A coin sorter apparatus as set forth in claim 2 including, third selected areas of recesses and ridges located in said stationary disk such that the rotating coins enter said third selected areas upon leaving said first selected areas, a channel formed of certain recesses in said third selected areas for receiving said coins of a thickness greater than said predetermined thickness from said first selected areas and directing those coins to a distinct radial position in preparation of rotational movement of the coins into the second selected areas.

4. A coin sorter apparatus as set forth in claim 3 wherein said third selected areas includes a camming surface which allows coins less than said predetermined thickness to assume a particular radial position different from the distinct radial position of said coins of a thickness greater than said predetermined thickness.

5. A coin sorter apparatus as set forth in claim 1 wherein said first selected areas of ridges and recesses includes a camming surface which radially aligns to a predetermined position the rotating coins which are free to move radially under the influence of centrifugal force.

6. A coin sorter apparatus as set forth in claim 1 wherein said first selected areas of the ridges and recesses includes a thickness discriminating area which presses and captures coins of a thickness greater than the depth of the recess into the rotating disk thereby preventing radial movement of the coins rotational path and a guide recess with a depth greater than the thickness of the captured coins for receiving the captured coins.

7. A coin sorter apparatus as set forth in claim 6 wherein said guide recess includes a camming surface which directs the coins within the guides recess to a radial position in anticipation of movement of the coin to said second selected areas.

8. A coin sorter apparatus as set forth in claim 1 wherein said second selected areas include a group of exit recesses located serially alopng the path of the rotating coins and radially positioned to capture and eject from between the two disks the coins which have been moved to distinct radial positions on the rotating disk.

9. A coin sorter apparatus for receiving and sorting mixed coins by denomination using coin thickness as a discriminating parameter, said apparatus comprising:

a rotating disk having a first surface for receiving said mixed coins and imparting a rotational movement to said mixed coins, a stationary disk having its underside parallel with said first surface of said rotating disk, a first area on the underside of said stationary disk including means for selectively directing a single layer of the rotating mixed coins into a region between the two disks, with said region allowing continued rotation of the mixed coins on the first surface of said rotating disk, a second area on the underside of said stationary disk including means for receiving said rotating coins from said first area and positioning at least one denomination of said coins at a distinct radial position in response to the thickness of that denomination of coin relative to the thickness of the other denominations of coins, a third area on the underside of said stationary disk including means for receiving said rotating coins from said second area and allowing rotating coins positioned at predetermined radial positions to exit the region between the two disks at predetermined locations along the periphery of the stationary disk, whereby each denomination of coin exits the region between the two disks at the same predetermined location along the periphery of the stationary disk.

10. A coin sorter apparatus for receiving and sorting mixed coins by denomination as set forth in claim 9 wherein said first surface of said rotating disk is resilient and said first, second and third areas selectively press said mixed coins into the resilient first surface as the coins are rotated on the rotating disk in a region between the two disks.

11. A coin sorter apparatus for receiving and sorting mixed coins by denomination as set forth in claim 9 wherein said first, second and third areas are comprised of recesses and ridges which cam the rotating coins to different radial positions on the surface of the rotating disk.

12. A coin sorter apparatus for receiving and sorting mixed coins by denomination as set forth in claim 11 where said first area of recesses and ridges receives the rotating coins into the region between the two disks in a single file formation with an edge of each rotating coin being radially cammed by the ridges and recesses of said first area.

13. A coin sorter apparatus for receiving and sorting mixed coins by denomination as set forth in claim 12 wherein said first area includes a recess for ejecting rotating coins from said first area whose coin edge is not being directly cammed by the ridges and recesses of said first area.

14. A coin sorter apparatus for receiving and sorting mixed coins by denomination as set forth in claim 9 wherein said second area includes a certain recess which receives the rotating coins, the certain recess having a depth greater than the thickness of some rotating coin denominations and less than the thickness of at least one denomination of rotating coin such that rotating coins in said certain recess are either pressed into the rotating surface and thereby held at a constant radius or are free to respond to centrifugal force and thereby move radially outward.

15. A coin sorter apparatus for receiving and sorting mixed coins by denomination as set forth in claim 14 wherein said certain recess includes a camming surface which aligns the rotating coins which are free to move radially to a predetermined radial position.

16. A coin sorter apparatus for receiving and sorting mixed coins by denomination as set forth in claim 14 wherein said second area includes a guide recess which receives the rotating coins pressed into the rotating surfaces by said certain recess, said guide recess having a depth greater than the rotating coins pressed into the rotating surface by said certain recess and also having a camming surface for radially positioning the rotating coins in said guide recess to a predetermined radial position.

17. A coin sorter apparatus for receiving and sorting mixed coins by denomination as set forth in claim 9 wherein said third area includes a series of discrete recesses which intercept the rotating coins positioned at predetermined radial positions and eject those coins which fit into the recess by allowing them to freely move radially.

18. A coin sorter apparatus for receiving and sorting mixed coins by denomination as set forth in clain 16 wherein said third area includes a series of discrete recesses which intercept the rotating coins positioned at predetermined radial positions and eject those coins which fit into the recess by allowing them to freely move radially.

19. A method of sorting mixed coins by denomination using coin thickness as a discriminating parameter and utilizing a rotating disk having a resilient surface, said method comprising the steps of:

rotating the mixed coins on the resilient surface of said rotating disk, pressing into the resilient surface of said rotating disk coins of a thickness greater than a predetermined thickness to prevent radial movement of the coins, allowing the rotating coins of a thickness less than a predetermined thickness to freely move radially in response to the centrifugal force imparted on the coins from the rotating disk, camming the radial movement of the rotating coins of a thickness less than said predetermined thickness to a radial position different from the radial position of the rotating coins of a thickness greater than said predetermined thickness, exiting from the rotating disk at a particular point of coin rotation all the coins which have been pressed into the resilient surface and prevented from moving to a more distant radial position.

20. A method of sorting mixed coins by denomination as set forth in claim 19 including the step of exiting from the rotating disk at unique points of coin rotation as determined by coin diameter all the rotating coins with a thickness less than said predetermined thickness.

* * * * *

UNITED STATES PATENT AND TRADEMARK OFFICE

CERTIFICATE OF CORRECTION

PATENT NO. : 4,543,969

DATED : October 1, 1985

INVENTOR(S) : James Rasmussen

It is certified that error appears in the above-identified patent and that said Letters Patent is hereby corrected as shown below:

In the Abstract:

On line 6, delete the period after "disks"

On line 7, change "Wherein" to -- wherein --

On line 7, change "are" to -- area --

Signed and Sealed this

*Twenty-ninth* Day of *July 1986*

[SEAL]

*Attest:*

DONALD J. QUIGG

*Attesting Officer*

*Commissioner of Patents and Trademarks*